US008870672B2

(12) United States Patent
Downing

(10) Patent No.: US 8,870,672 B2
(45) Date of Patent: Oct. 28, 2014

(54) PORTABLE GOLF PUTTING TARGET

(76) Inventor: Scott J. Downing, Franklin, IN (US)

( * ) Notice: Subject to any disclaimer, the term of this patent is extended or adjusted under 35 U.S.C. 154(b) by 145 days.

(21) Appl. No.: 13/593,944

(22) Filed: Aug. 24, 2012

(65) Prior Publication Data

US 2013/0053158 A1 Feb. 28, 2013

Related U.S. Application Data

(60) Provisional application No. 61/526,879, filed on Aug. 24, 2011, provisional application No. 61/564,900, filed on Nov. 30, 2011.

(51) Int. Cl.

| | |
|---|---|
| ***A63B 69/36*** | (2006.01) |
| ***A63B 63/00*** | (2006.01) |
| *A63B 57/00* | (2006.01) |

(52) U.S. Cl.

CPC ..... *A63B 63/00* (2013.01); *A63B 57/0056* (2013.01); *A63B 69/3676* (2013.01)

USPC ..... 473/164; 473/174

(58) Field of Classification Search

CPC ..... A63B 47/0056; A63B 69/3676; A63B 69/3697; A63B 63/00; A63B 67/02; B60B 33/0038; B60B 33/0036; B60B 33/0039

USPC ..... 473/157–196; 16/45

See application file for complete search history.

(56) References Cited

U.S. PATENT DOCUMENTS

| | | | | | |
|---|---|---|---|---|---|
| 214,518 | A | * | 4/1879 | Munger | 16/45 |
| 1,528,056 | A | * | 3/1925 | Herbert | 473/405 |
| 1,882,963 | A | * | 10/1932 | Scanlan | 473/179 |
| 1,888,726 | A | * | 11/1932 | Jarvis et al. | 16/18 CG |
| 2,635,879 | A | | 4/1953 | Rath | |
| 2,849,238 | A | * | 8/1958 | Eldredge | 473/180 |
| 3,048,405 | A | * | 8/1962 | McCaul | 473/180 |
| 3,194,293 | A | * | 7/1965 | Kindley | 152/327 |
| 3,512,262 | A | * | 5/1970 | Smyk et al. | 33/555.2 |
| 3,891,221 | A | * | 6/1975 | Gordon | 473/174 |
| 4,368,888 | A | * | 1/1983 | Ren | 473/164 |
| 4,722,115 | A | * | 2/1988 | Yang | 16/45 |
| 5,120,063 | A | * | 6/1992 | Birchler et al. | 473/180 |
| 5,261,670 | A | * | 11/1993 | Mull | 473/182 |

(Continued)

OTHER PUBLICATIONS

AdvantageEDGE Pro Putt 360, "pro_putt_360_advantedge_Golfsmith_printout.pdf", printout of webpage "http://reviews.golfsmith.com/8567/30080466/pro-putt-360-precision-targeting-and-alignment-system-reviews/reviews.htm".

(Continued)

*Primary Examiner* — Mark Graham

(74) *Attorney, Agent, or Firm* — Maginot, Moore & Beck, LLP

(57) ABSTRACT

A golf putting target includes an upper wall portion, the upper wall portion defining a central opening. The target also includes a cylindrical outer wall portion extending beneath the upper wall portion that includes a bottom edge. A tee support portion extends beneath the upper wall portion proximate the central opening, The upper wall portion and the cylindrical outer wall portion define a hollow interior that is open through the bottom edge. The cylindrical outer wall portion has a body has a height that is at least half of a diameter of a regulation-sized golf ball, and has a diameter that is less than or equal to a diameter of a regulation-sized golf cup.

2 Claims, 6 Drawing Sheets

(56) References Cited

U.S. PATENT DOCUMENTS

| | | | | |
|---|---|---|---|---|
| 5,275,404 | A | 1/1994 | Dimaano et al. | |
| 5,282,626 | A * | 2/1994 | Millar | 473/174 |
| 5,766,086 | A * | 6/1998 | Folsom | 473/185 |
| D400,631 | S | 11/1998 | Moore | |
| 5,971,863 | A * | 10/1999 | Durso | 473/159 |
| 6,607,449 | B2 | 8/2003 | McCabe | |
| 7,052,407 | B2 | 5/2006 | Patterson | |
| 7,837,573 | B1 * | 11/2010 | Bullock | 473/174 |
| 2004/0092324 | A1 * | 5/2004 | Burkholder | 473/174 |
| 2008/0132348 | A1 * | 6/2008 | Prince | 473/174 |

OTHER PUBLICATIONS

Nuru Putting Puck, "Nuru_Putting_Puck_Amazon_printout,pdf", printout of webpage "http://www.amazon.com/Nuru-Golf-Putting-Trainer-Training/dp/B001W9CP92".

Putt Pucks Targets, "www_puttpucks_com.pdf", printout of webpage "http://www.puttpucks.com/targets/".

* cited by examiner

PORTABLE GOLF PUTTING TARGET

TECHNICAL FIELD

This invention relates to the sport of golf, and, in particular, to training aids and devices for practicing putting.

BACKGROUND

A variety of devices have been conceived for the practice putting of golf balls. These devices typically comprise some type of simulated golf cup that serves as a target for a golfer to putt toward. Putting targets can be simple devices such as flat discs that can be placed on the ground that are the size of a golf cup, or complicated devices that are configured to receive the ball and automatically return the ball toward the golfer.

Previously known putting targets, however, typically have one or more characteristics that make the putting target inconvenient and/or impractical for use as a regular part of a golfer's practice strategy. For example, most putting aids and targets are too big and/or heavy to be added to the equipment that is already carried by a golfer. Flat targets may be light weight but are generally incapable of providing an indication or feedback as to the accuracy or speed of the putt.

What is needed is a putting target that is lightweight so it can be easily carried by a golfer or caddie in addition to the golf bag, clubs, golf balls, and other items that are typically carried on a golf course, that will remain in place when placed on the ground even when hit by a golf ball, and that is capable of providing feedback as to the accuracy of putting.

SUMMARY

In accordance with one embodiment of the present disclosure, a golf putting target includes an upper wall portion, the upper wall portion defining a central opening. The target also includes a cylindrical outer wall portion extending beneath the upper wall portion that includes a bottom edge. A tee support portion extends beneath the upper wall portion proximate the central opening, The upper wall portion and the cylindrical outer wall portion define a hollow interior that is open through the bottom edge. The cylindrical outer wall portion has a body has a height that is at least half of a diameter of a regulation-sized golf ball, and has a diameter that is less than or equal to a diameter of a regulation-sized golf cup.

DRAWINGS

DESCRIPTION

Figure 1:
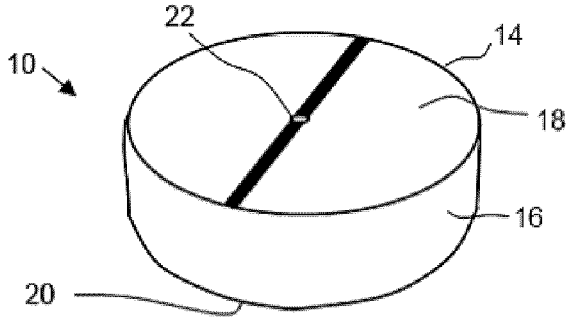
FIG. 1 is a perspective view of a golf putting target according to one embodiment of the present disclosure.
Figure 2:
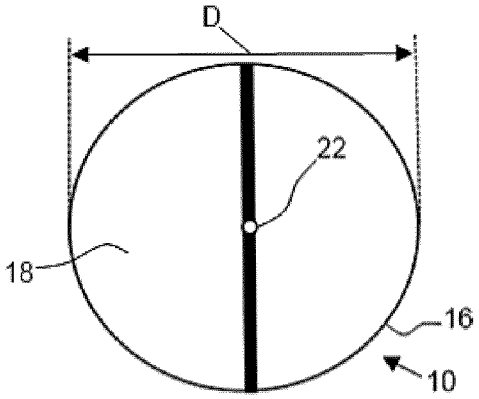
FIG. 2 is a top elevational view of the golf putting target of FIG. 1 shown in relation to a regulation sized golf ball and golf cup.
Figure 3:
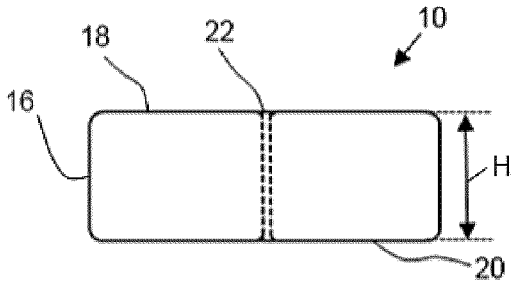
FIG. 3 is a side elevational view of the golf putting target of FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring now to FIGS. 1-4, one embodiment of a golf putting target 10 in accordance with the present disclosure is shown. As depicted, the golf putting target 10 comprises a generally cylindrical body 14 having a cylindrical perimeter surface 16, a generally flat upper surface 18, and a generally flat lower surface 20. The putting target 10 has a predetermined diameter D and a predetermined height H that corresponds to the distance between the upper and lower surfaces 18, 20.

The height H and diameter D of the putting target 10 are selected to simulate hitting the golf ball at a regulation sized golf cup or hole. More specifically, the putting target 10 is sized so that when a golf ball makes contact with the target, the center mass of the golf ball is at or inside the diameter of an imaginary golf cup. Thus, putting accuracy can be practiced and improved by putting a golf ball at a target that is smaller than a regulation sized golf cup. In addition, by making contact with the putting target, a golfer receives feedback as to the accuracy of the putts.

Figure 5:
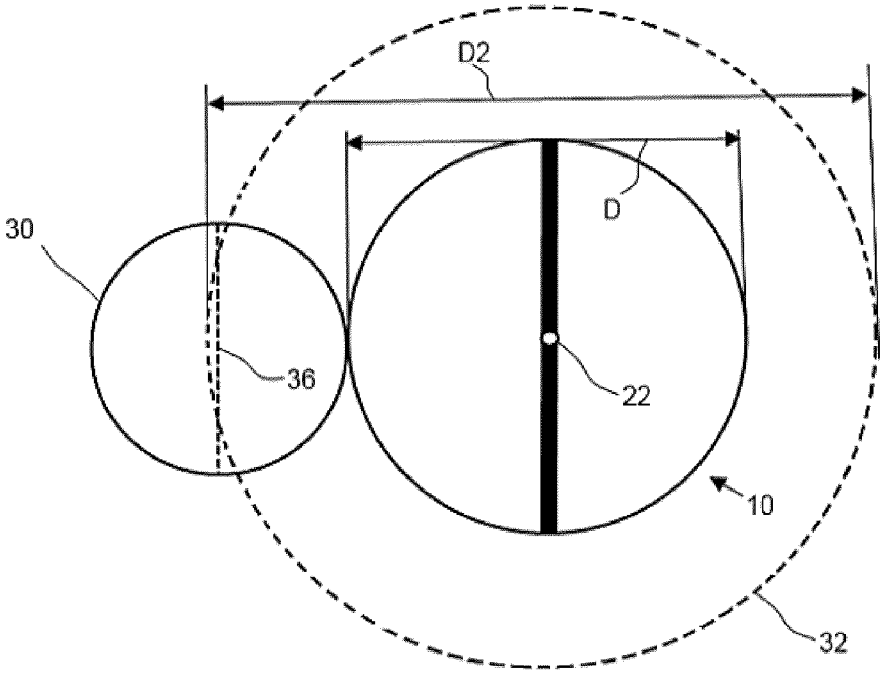
FIG. 5 is a top elevational view of the putting target of FIG. 1 shown in relation to a regulation sized golf ball and golf cup.
Figure 6:
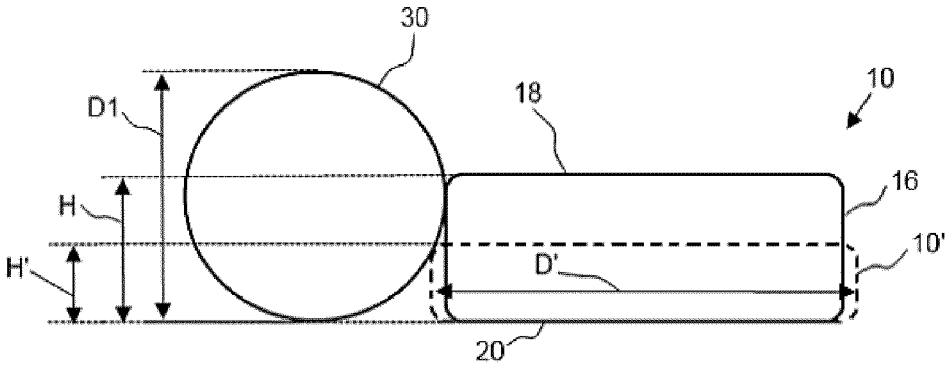
FIG. 6 is a side elevational view of the putting target of FIG. 1 shown in relation to a regulation sized golf ball.

The dimensions of the putting target 10 are thus a function of the sizes of a regulation sized golf ball and a regulation sized golf cup. Referring to FIGS. 5 and 6, the putting target 10 has a height H that is approximately half the diameter D1 of a golf ball 30 which enables the target 10 to be contacted by the golf ball at its widest point. The target 10 has a diameter D that corresponds to the width, or diameter, D2 of a golf cup 32 minus the diameter D1 of a golf ball (D=D2−D1). Currently, a regulation sized golf ball 30 has a diameter D1 of approximately 1.68 inches. A regulation size golf cup has a diameter D2 of approximately 4.25 inches. Therefore, in one embodiment, the putting target 10 has a diameter D of approximately 2.57 inches or less. Smaller diameter targets are harder to hit and may be beneficial for professional golfers and other skilled golfers.

As can be seen in FIG. 5, the dotted line 32 represents the size of a golf cup in relation to the putting target 10. The center mass 36 of a golf ball 30 that makes contact with the putting target 10 is at or within the dotted line 32 that represents a golf cup. As most golfers know, a golf ball that is hit along the left or right edge of a golf cup does not always go in even when the center mass of the golf ball is within the diameter of the cup.

Therefore, the diameter D of the putting target 10 may be selected so that the center mass 36 of the golf ball 30 is well within the diameter D2 of the golf cup when the ball 30 hits the target 10 in order to provide a more accurate indication of a successful putt.

A putting target 10 may be provided with a height that is less than half of the diameter D1 of a golf ball 32. In this case, the diameter D of the target 10 is increased to accommodate the reduction in height so that the target has the same effective size. For example, as seen in FIG. 6, a target 10' having a height H' that is less than half the diameter D1 of a golf ball 30 will make contact with the golf ball 30 below the widest point. The diameter D' of the target 10' is increased so that when the golf ball 30 contacts the target 10', the center mass of the golf ball is at or within the perimeter of a golf cup. The height and diameter of a target can therefore be varied without altering the effective target size.

Figure 4:
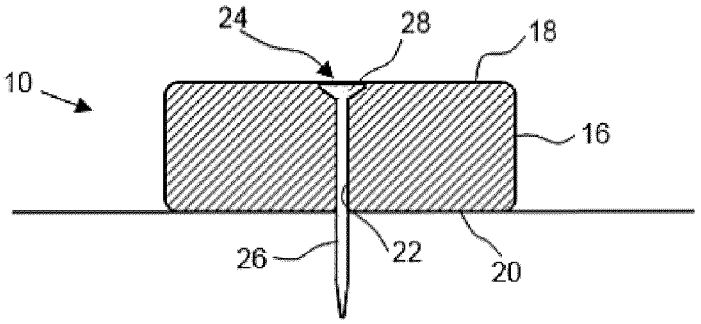
FIG. 4 is cross-sectional view of the putting target of FIG. 1 showing the target anchored to the ground by a golf tee.

Referring again to FIGS. 1-4, the target 10 includes a passage or opening 22 that extends through the upper and lower surfaces 18, 20 in alignment with the center axis of the cylindrical body 14. The target 10 may be anchored to the ground by extending the longitudinal portion 26 of a golf tee 24 or similar type of structure through the opening 22 and into the ground as depicted in FIG. 4. The opening 22 in the target 10 is smaller than the head 28 of the tee 24. The head 28 of the tee 24 may therefore be pressed against the upper surface 18 of the target 10 so that the target 10 is held firmly in place on the ground.

In alternative embodiments, other types of anchoring systems may be incorporated into the target. For example, the target may be provided with a prong mechanism (not shown) that is configured to extend from the bottom surface to grasp the ground. This type of anchoring system is particularly suitable for indoor use on carpets. The prong mechanism can be secured to the opening at the center of the target and include an actuator that extends from the upper surface. When the actuator is pressed down or pulled up in relation to the target, the prongs pull together to grasp ground or carpet material and secure the target thereto.

The putting target 10 is formed of a lightweight, durable material that is suitable for outdoor use and that is capable of withstanding repeated impacts by golf balls while maintaining its shape. In the embodiment of FIGS. 1-4, the putting target 10 is formed of a closed cell foam material. Examples of suitable closed cell foam material include EVA (Ethylene vinyl acetate) foam, volara foam, minicel foam, neoprene foam, and polyethylene foam. Closed cell structure foams have high dimensional stability which enables the putting target to retain its shape after being impacted repeatedly by golf balls. Closed cell foam also has a low moisture absorption coefficient so the target will be less likely to absorb and retain water when used on wet ground. Any suitable type of foam material, however, may be used including open cell foams.

The weight of the target 10 is an important consideration in the design. The amount of weight that a golfer or caddie must carry is already significant when considering all of the golf clubs, golf balls, and other items. The use of foam for the putting target 10 enables the target to be extremely lightweight which allows the target to be carried in a pocket or added to the golf bag without having an impact on the overall weight carried by a golfer or caddie.

In addition to being lightweight, the use of foam material for the target 10 adds deformability and resiliency to the target 10 which enhances feedback. As used herein, the term "feedback" refers to the ability of the target 10 to provide an indication of degree of accuracy as well as the speed of the putt. Foam material is capable of deforming and rebounding in response to contact with a golf ball. The rebounding material of the target adds energy to the ball that augments the deflection of the ball from the target. A golfer is therefore provided with an enhanced visual indication of how the golf ball was hit based on the degree and angle of deflection.

Figure 7:
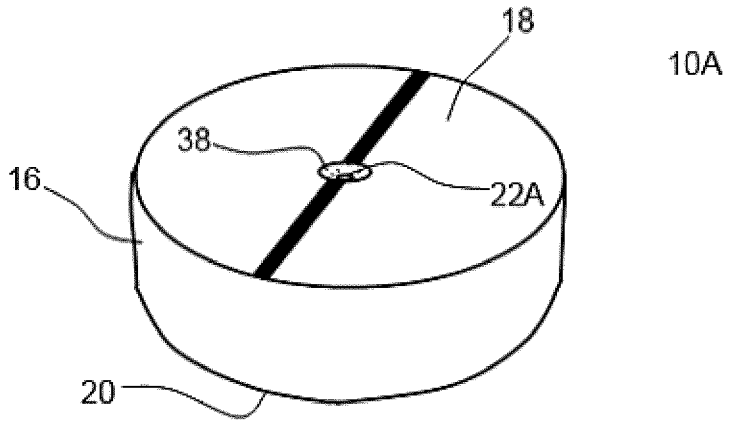
FIG. 7 is a perspective view of another embodiment of a golf putting target.
Figure 8:
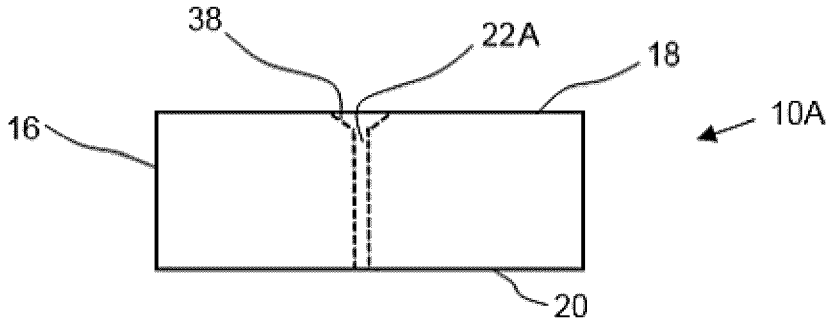
FIG. 8 is a side elevational view of the golf putting target of FIG. 7.
Figure 9:
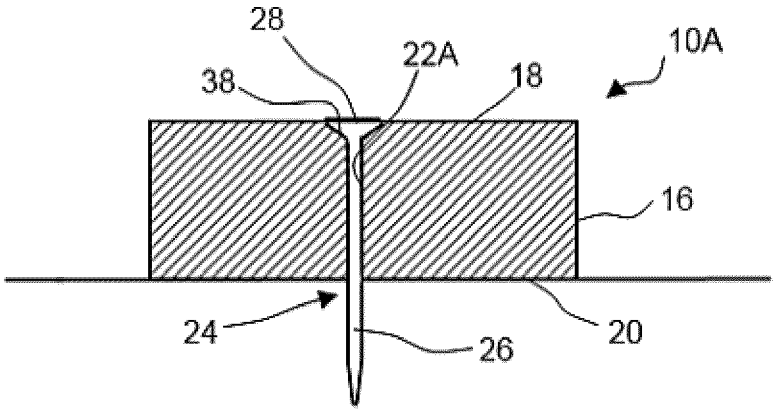
FIG. 9 is cross-sectional view of the putting target of FIG. 7 showing the target anchored to the ground by a golf tee.
Figure 10:
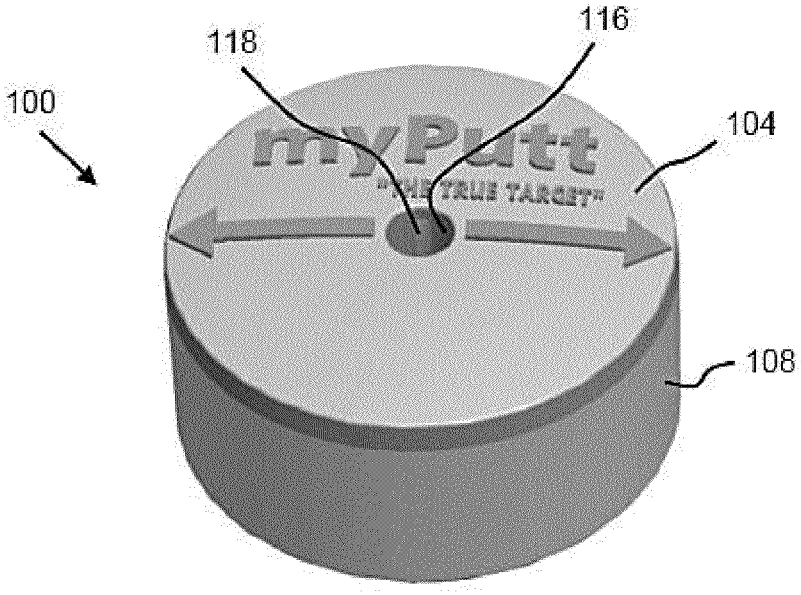
FIG. 10 is a top perspective view of another embodiment of a putting target.
Figure 11:
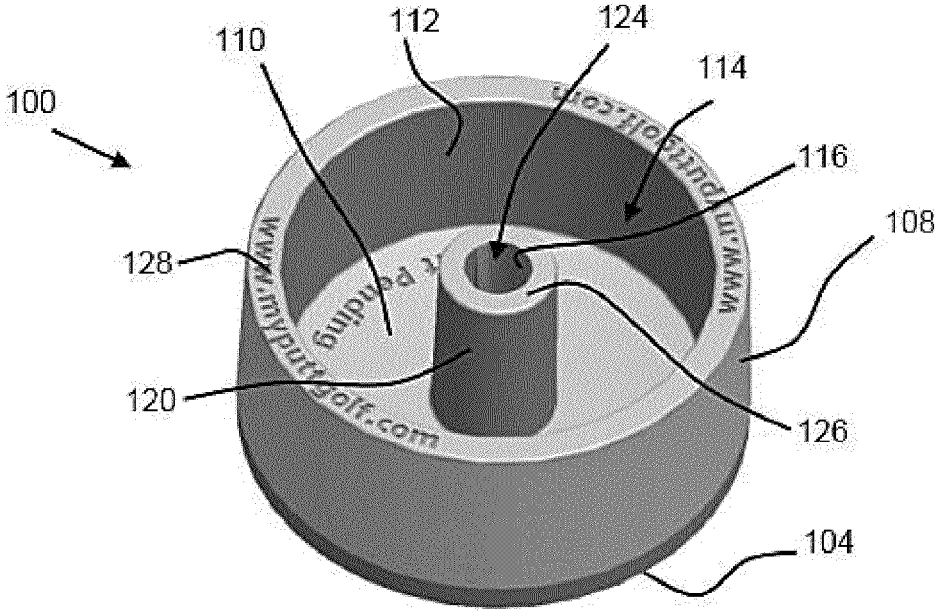
FIG. 11 is a bottom perspective view of the target of FIG. 10.
Figure 12:
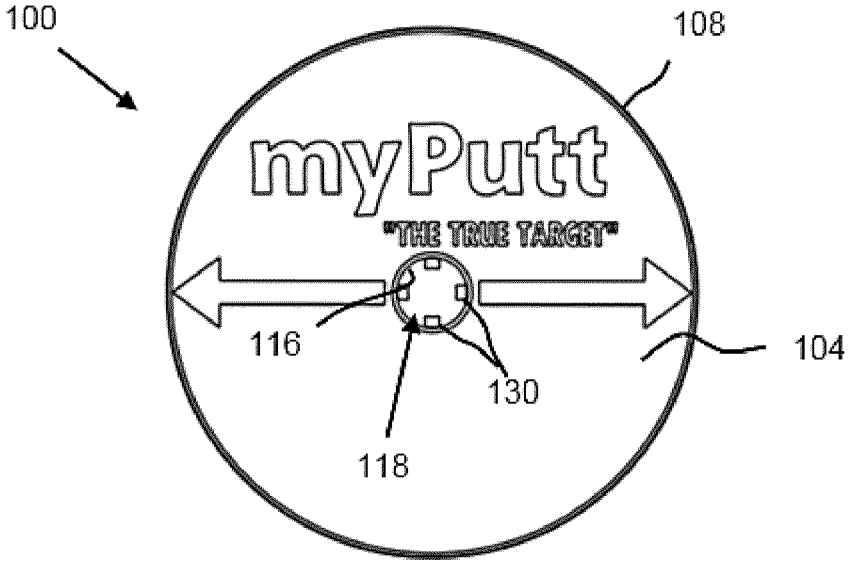
FIG. 12 is a top elevational view of the target of FIG. 10.
Figure 13:
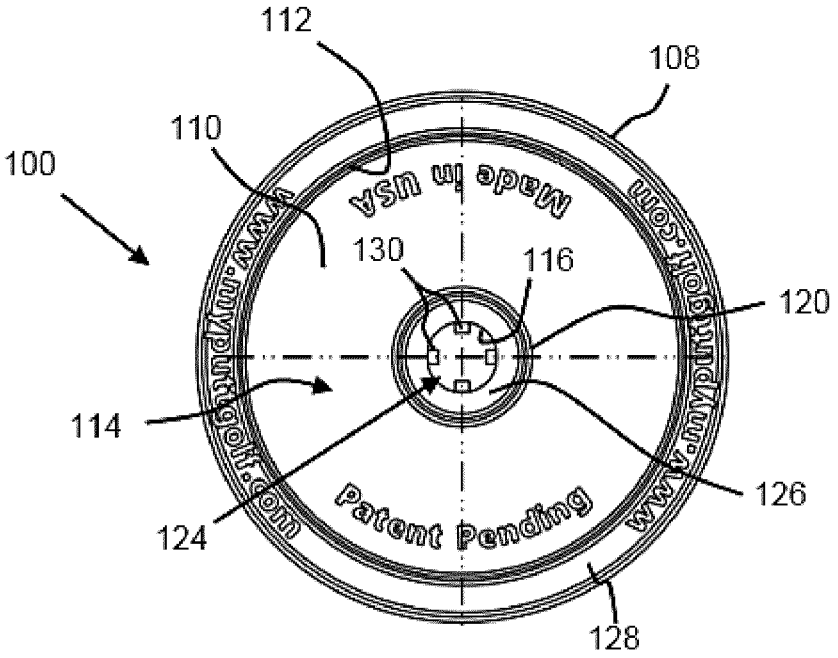
FIG. 13 is a bottom elevational view of the target of FIG. 10.
Figure 14:
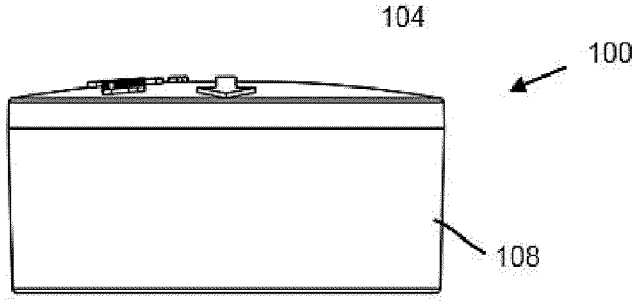
FIG. 14 is a side elevational view of the target of FIG. 10.

As an alternative to the use of foam material, the putting target may be formed of a rigid material, such as hard plastic material, as depicted in FIGS. 7-9. The target 10A of FIGS. 7-9 has substantially the same size and shape as the embodiment of FIGS. 1-4. In this embodiment, the opening 22A that is provided in the center of the target 10A is countersunk in the upper surface 18 to receive the head 28 of the tee 24 when the tee is inserted through the opening 22. The countersink 38 enables the head 28 of the tee 24 to press the target 10A against the ground so that the target is firmly held in place.

The putting target may be provided with substantially any exterior color. Preferably, the target 10 has an exterior color that can be easily seen when placed against the putting surface. For example, a white target can be easily seen when putting on a green putting surface although other suitable colors for can be used, such as blue, black, yellow, etc. Of course, the color of the target can be selected based on customer preference. In some embodiments, the upper half and lower half of the putting target can be provided with different exterior colors for use on different colored surfaces or in different lighting conditions. The color of the target can be incorporated into the foam material itself. Alternatively, the putting target can be provided with a coating material that has the desired color. Coating materials may also be used to protect, strengthen, and waterproof the exterior surface of the target.

The exterior surface of the putting target may also be provided with lines, symbols, alphanumeric characters, and other markings to further enhance the ability of the target to facilitate putting and for other reasons. As depicted, the putting target 10 is provided with a straight line marking 40 that extends across the center of the upper and lower surfaces 18, 20. The line mark 40 may be used by a golfer to help align the putt. In alternative embodiments, multiple lines may be provided across the upper and lower surfaces 18, 20.

FIGS. 10-16 show another alternative embodiment of a putting target 100 in accordance with the present disclosure. The putting target 100 of FIGS. 10-16 is formed of a thermoplastic elastomer (TPE) material having a configuration that enables the target to be extremely light weight while retaining generally the same target size and shape as the previous embodiments.

The putting target 100 includes an upper wall portion 104 and a cylindrical outer wall portion 108. The upper wall portion 104 and the outer wall portion 108 include interior surfaces 110, 112 that collectively define a hollow interior space 114. The bottom of the target 100 is open to the hollow interior 114. Hollowing the interior and removing the bottom of the target 100 allows the target to be extremely light weight.

The upper wall portion 104 defines a central opening 118 for receiving a golf tee or similar structure (not shown) that is used to anchor the putting target 100 to a surface, such as a putting green. The opening 118 leads to the hollow interior 114. A golf tee or similar type of structure can be inserted through the opening 118 and into the ground beneath the target 100 to secure the target 100 to the ground. The tee can be inserted through the opening 118 and into the ground at a variety of angles to enable the target 100 to be anchored securely and tightly to the ground. Although a single opening 118 is provided in the center of the upper wall portion 104 of the target 100, in alternative embodiments, the opening 118 may be offset from the center of the upper wall portion and may be located substantially anywhere in the upper wall portion of the target. In addition, in some embodiments, multiple openings may be provided through the upper wall portion 104 to enable the target 100 to be anchored to the ground from different positions in the target with one or more tees.

As depicted, the target 100 includes a tee support portion 120 that extends from the interior surface 110 of the upper wall portion 104 to the ground. The tee support portion 120 has a generally cylindrical configuration with an inner wall 116 that defines an open-ended passage 124 extending from the central opening 118 through which the golf tee extends prior to penetrating the ground. The tee support portion 120 extends from the interior surface 110 a distance that enables the distal end portion 126 of the tee support portion 120 to be aligned with the bottom edge 128 of the outer wall portion 108 so that the distal end portion 126 of the tee support portion 120 and the bottom edge 128 of the outer wall portion 108 each rest on the surface upon which the putting target is utilized. The tee support portion 120 thus adds support to the center portion of the target. The flexibility of the material of the target 100 allows the tee support portion 120 of the target to bend to adapt to the various angles of the tee used to secure the target to the ground. In alternative embodiments, the tee support portion 120 can be shortened, attenuated, or omitted to allow the tee to pass freely from the opening 118 to the ground.

The tee support portion 120 includes tee retaining structures 130 that protrude into the passage 124 from the inner wall 116. The tee retaining structures 130 are configured to frictionally engage the stem portion of a golf tee to releasably retain the golf tee within the passage 124. In the embodiment of FIGS. 10-16, the tee retaining structures 130 comprise ribs. As depicted, four ribs are evenly spaced about the passage 124. The distance that the ribs 130 extend into the passage 124 depends on the width of the passage 124 and the diameter of a golf tee. In the embodiment of FIGS. 10-16, the passage 124 has a width or diameter of approximately 0.30 inches. The ribs 130 extend into the passage from the inner wall 124 a distance of approximately 0.09 inches to define a gap or passage for the tee of approximately 0.21 inches. In other embodiments, more or fewer ribs or tee retaining structures having other configurations may be utilized.

The thicknesses of the upper wall portion 104 and the outer wall portion 108 are selected to provide the putting target 100 with adequate support for retaining its shape while minimizing weight. The thickness of the walls 104, 108 of the putting target 100 is also at least partially dependent upon the process used in manufacturing the target. The target 100 of FIGS. 10-16 is formed in a molding or injection molding process. In one embodiment, the outer wall portion 108 and the upper wall portion 104 have a thickness of approximately 0.18 inches although any suitable thickness may be utilized.

Figure 16:
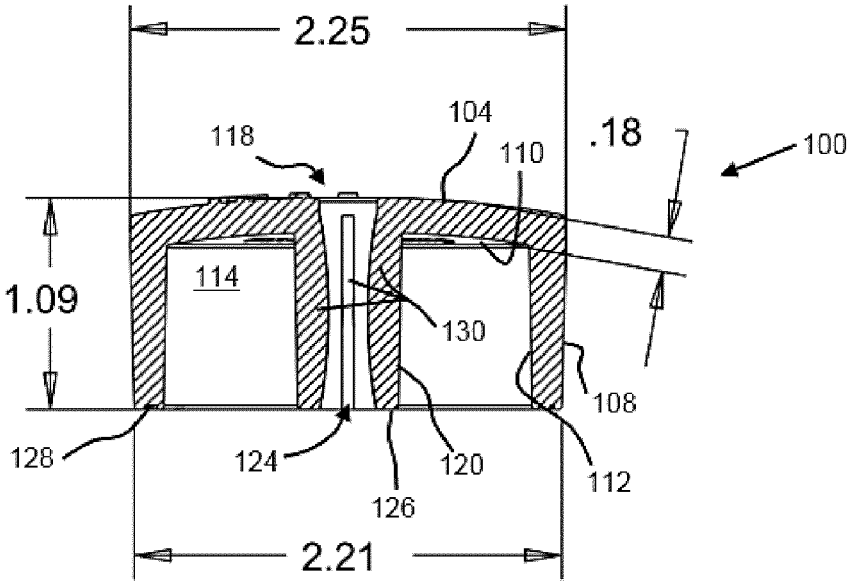
FIG. 16 is another cross-sectional view of the target of FIG. 10.

Similar to the previous embodiments, the height and outer diameter of the target is a function of the sizes of a regulation sized golf ball and a regulation sized golf cup. As depicted in FIG. 16, the outer diameter of the target 100 is approximately 2.25 inches although the diameter may be increased or decreased for different targets to make the target easier or more difficult to hit. The height of the target 100 as depicted is approximately 0.85 inches.

Figure 15:
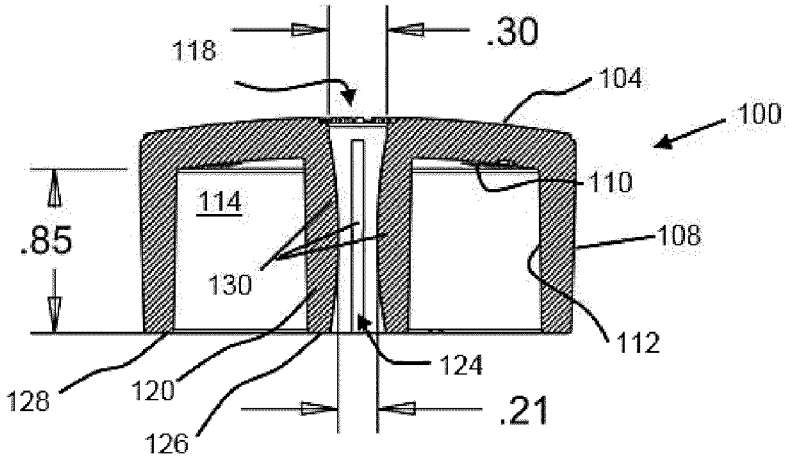
FIG. 15 is a cross-sectional view of the target of FIG. 10.

The walls 104, 108, 120 of the target 100 have a configuration that facilitates formation using a molding process. For example, as depicted in FIGS. 15 and 16, the outer wall portion 108 and the tee support portion 120 are drafted, i.e., taper, downwardly from the upper wall portion to facilitate removal from a mold. In addition, the upper wall portion 140 is slightly dome-shaped to further facilitate removal of the target from the mold.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A golf putting target comprising:

an upper wall portion, the upper wall portion defining a central opening;

a cylindrical outer wall portion extending beneath the upper wall portion, the cylindrical outer wall portion including a bottom edge; and a tee support portion extending beneath the upper wall portion proximate the central opening, wherein the upper wall portion and the cylindrical outer wall portion define a hollow interior that is open through the bottom edge, wherein the cylindrical outer wall portion has a height that is greater than or equal to a diameter of a regulation-sized golf ball, wherein the cylindrical outer wall portion has a diameter that is less than or equal to a diameter of a regulation-sized golf cup, wherein the upper wall portion, cylindrical outer wall portion, and tee support portion are formed of a thermoplastic elastomer, wherein the tee support portion defines a passage that extends from the central opening, wherein the tee support portion includes tee retaining structures for releasably retaining a golf tee, and wherein the tee retaining structures comprise ribs that protrude into the passage.

2. The target of claim 1, wherein the central opening and the passage each have a diameter that is less than the diameter of a head of a golf tee.

* * * * *